US009108203B2

(12) United States Patent
Jiang et al.

(10) Patent No.: US 9,108,203 B2
(45) Date of Patent: Aug. 18, 2015

(54) MAGNETIC DRUM SEPARATOR WITH AN OUTER SHELL HAVING TRACTION ELEMENTS

(71) Applicants: Xinkai Jiang, Fairview, PA (US); Timothy G. Shuttleworth, Girard, PA (US)

(72) Inventors: Xinkai Jiang, Fairview, PA (US); Timothy G. Shuttleworth, Girard, PA (US)

(73) Assignee: Eriez Manufacturing Co., Erie, PA (US)

( * ) Notice: Subject to any disclaimer, the term of this patent is extended or adjusted under 35 U.S.C. 154(b) by 31 days.

(21) Appl. No.: 13/782,414

(22) Filed: Mar. 1, 2013

(65) Prior Publication Data

US 2014/0246359 A1 Sep. 4, 2014

(51) Int. Cl.
*B03C 1/14* (2006.01)

(52) U.S. Cl.
CPC ..... *B03C 1/145* (2013.01); *B03C 2201/20* (2013.01)

(58) Field of Classification Search
CPC ..... B03C 1/10; B03C 1/14; B03C 1/145
USPC ..... 209/219, 220, 223.2, 225
See application file for complete search history.

(56) References Cited

U.S. PATENT DOCUMENTS

| | | | | |
|---|---|---|---|---|
| 3,985,647 | A | 10/1976 | Smith | 209/218 |
| 4,013,561 | A | 3/1977 | Murphy | 210/222 |
| 5,626,233 | A | 5/1997 | Wells, II | 209/219 |
| 7,918,345 | B2 * | 4/2011 | Molteni | 209/215 |
| 8,056,728 | B2 * | 11/2011 | Riise et al. | 209/8 |
| 8,196,751 | B2 * | 6/2012 | Shuttleworth et al. | 209/215 |
| 2013/0146510 | A1 * | 6/2013 | Ross | 209/223.2 |

FOREIGN PATENT DOCUMENTS

| | | |
|---|---|---|
| CN | 201313074 | 9/2009 |
| DE | 3333344 | 3/1985 |
| EP | 0382326 | 8/1990 |
| EP | 1520627 | 4/2005 |
| GB | 488420 | 7/1938 |
| GB | 524075 | 7/1940 |
| GB | 703692 | 2/1954 |
| GB | 703971 | 2/1954 |
| GB | 777011 | 6/1957 |

* cited by examiner

*Primary Examiner* — Joseph C Rodriguez
(74) *Attorney, Agent, or Firm* — Jonathan M. D'Silva; MacDonald, Illigg, Jones & Britton LLP

(57) ABSTRACT

A magnetic drum separator for the separation of ferrous and non-ferrous materials from a material stream that comprises an outer shell that is rotatable by a drive mechanism. The outer shell has a tubular length, a circular cross-section, a traction plate is joined to the outer shell, the traction plate has a traction element. In another embodiment the outer shell has a tubular length, a circular cross-section, and a integral traction element. The traction elements could be a series of negative indentations, raised bumps, perforations, serrated teeth, protruding ridges, segmented protruding ridges, minor cleats, or segmented minor cleats.

13 Claims, 18 Drawing Sheets

MAGNETIC DRUM SEPARATOR WITH AN OUTER SHELL HAVING TRACTION ELEMENTS

This application takes priority from U.S. provisional application No. 61/605,996 filed Mar. 2, 2012, which is incorporated herein by reference.

BACKGROUND

Magnetic drum separators are used to sort shredded scrap material streams that comprise various combinations of ferrous material and non-ferrous materials (including non-metals, sometimes known as organic material or fluff, and non-magnetic metals) by extracting the ferrous material from the material stream. Sometimes during this sorting process non-ferrous materials will get stuck to or bound up with the ferrous material while in the material stream and remain with the ferrous material, even after the magnetic drum separator has tried to separate the material stream. This reduces the efficiency of downstream process and subsequently creates a negative economic impact on the resale value of the ferrous material. Ultimately, such a negative economic impact may actually reduce the overall value of the entire plant sorting ferrous and non-ferrous materials. What is presented are devices for agitating the sorted non-ferrous materials to reduce entrapment (i.e. the amount of non-ferrous scrap bound up with the ferrous material) after sorting.

SUMMARY

What is claimed is a magnetic drum separator for the separation of ferrous and non-ferrous materials from a material stream comprising an outer shell that is rotatable by a drive mechanism. The outer shell has a tubular length and a circular cross-section. A traction plate that has a traction element is joined to the outer shell. The magnetic drum separator could comprise a standard cleat joined to the outer shell. The traction plates could be made from stainless steel, manganese steel, or other materials. The traction plate could be sized to fit the tubular length of the outer shell or be releasably joined to the outer shell. The traction element could be a minor cleat. The magnetic drum separator could further comprise at least two traction plates with one of the traction plates having a traction element that is a minor cleat and the other traction plate a different traction element. The traction element could be configured in many ways, including a series of negative indentations, raised bumps, perforations, serrated teeth, protruding ridges, segmented protruding ridges, minor cleats, or segmented minor cleats.

In another embodiment, a magnetic drum separator comprises an outer shell that is rotatable by a drive mechanism. The outer shell has a tubular length, a circular cross-section, and an integral traction element. This outer shell of this magnetic drum separator embodiment could be made from stainless steel or manganese steel. In some embodiments, the traction elements span across the tubular length of the outer shell. Some magnetic drum separator embodiments could have a standard cleat joined to the outer shell. This magnetic drum separator embodiment could comprise an integral traction element that is a minor cleat. The magnetic drum separator could have traction plates having their own traction elements in combination with the integral traction elements on the outer shell. The integral traction element in this embodiment could be a series of negative indentations, raised bumps, perforations, serrated teeth, protruding ridges, segmented protruding ridges, minor cleats, or segmented minor cleats.

In another embodiment, a magnetic drum separator comprises an outer shell that is rotatable by a drive mechanism. The outer shell has a tubular length, a circular cross-section, and a traction means for causing the material stream to tumble on the outer shell and to separate the ferrous material from the non-ferrous material. This magnetic drum separator embodiment could also comprise the outer shell having a standard cleat joined to it.

BRIEF DESCRIPTION OF DRAWINGS

For a more complete understanding and appreciation of this invention, and its many advantages, reference will be made to the following detailed description taken in conjunction with the accompanying drawings.

DETAILED DESCRIPTION

Figure 1:
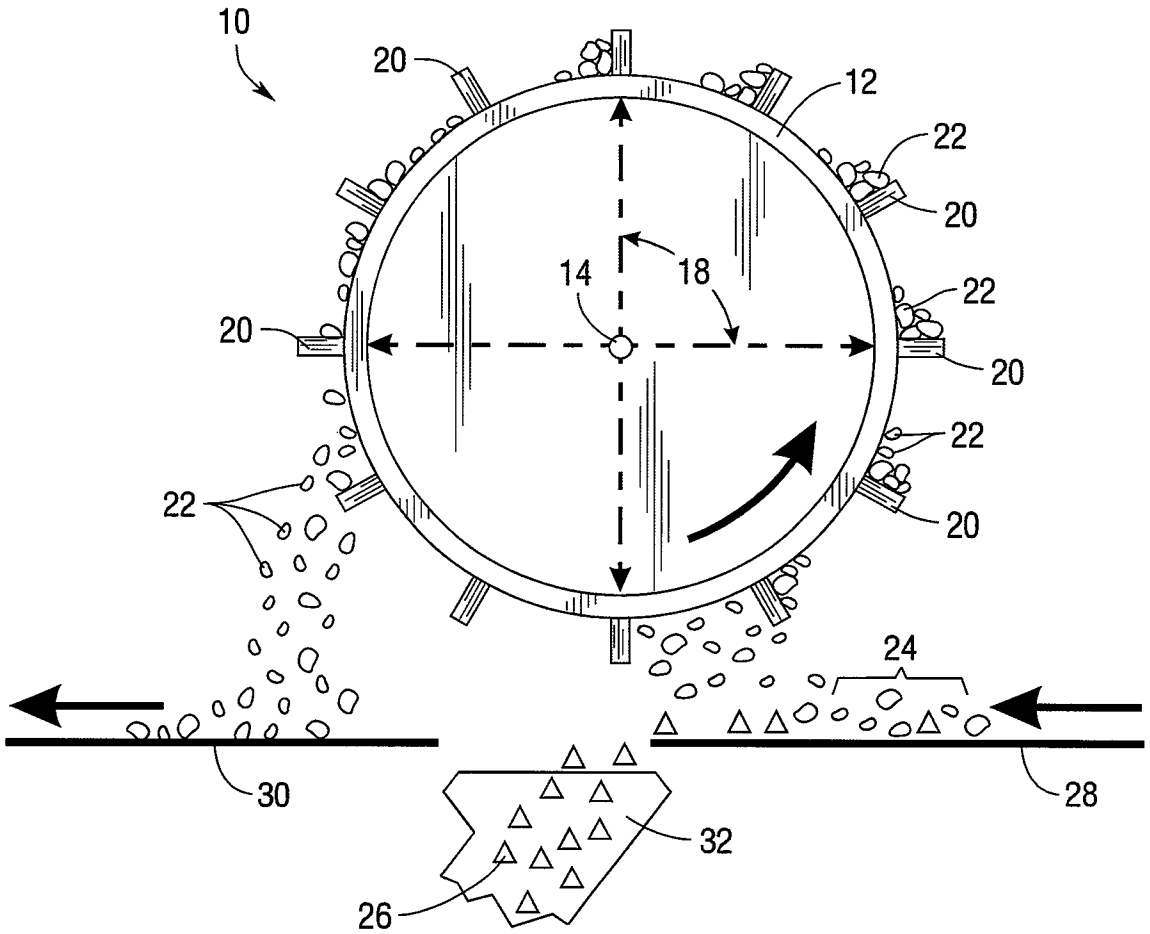
Prior Art Fig.1
FIG. 1 shows a prior art magnetic drum separator in operation.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

Figure 2:
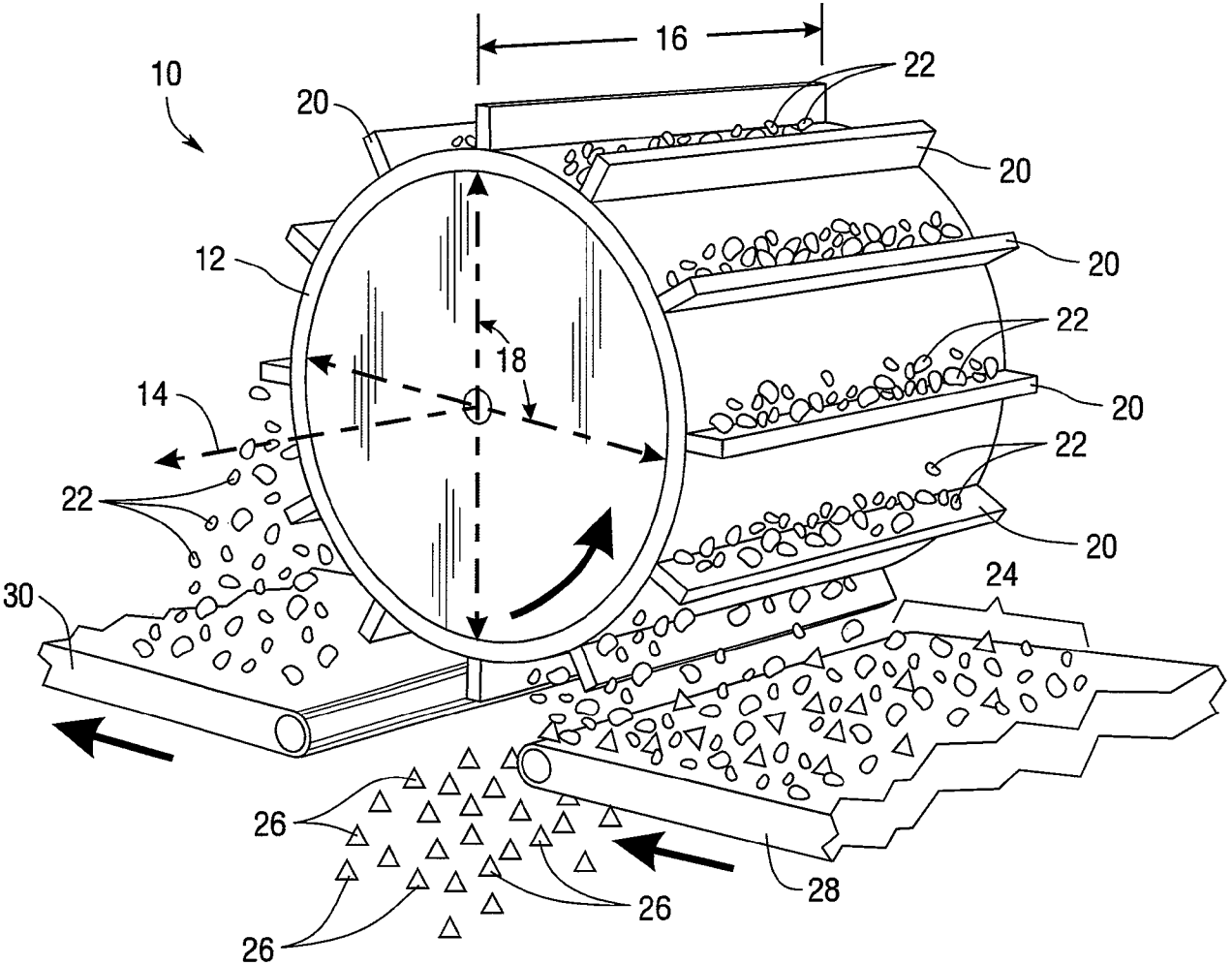
Prior Art Fig.2
FIG. 2 shows a perspective view of the prior art drum separator of FIG. 1.

Magnetic drum separator systems typically process several hundred tons of raw materials a day and even several hundred tons per hour depending on the size of the facility and the size of the equipment being used. As shown in FIGS. 1 and 2, typical magnetic drum separators 10 consist of an outer shell 12 that is rotatable around a central axis 14 of rotation by a drive mechanism (not shown) in the direction indicated in the figures and around a number of parts (not shown) housed within the outer shell 12. The outer shell 12 has a tubular length 16 and a circular cross section 18. The outer shell 12 of the magnetic drum separator 10 could also comprise a series of standard cleats 20 that assist the movement of the ferrous 22 material on the outer shell 12 of the magnetic drum separator 10.

The material stream 24 to be sorted comprises a mixture of ferrous 22 material and non-ferrous 26 materials. The material stream 24 passes under the drum separator 10 using any appropriate first transfer system 28 such as conveyors, chutes, vibrators, etc. while the outer shell 12 rotates. The ferrous 22 material is magnetically attracted to the drum separator 10 and becomes magnetically attached to the surface of the outer shell 12. As the outer shell 12 rotates, the magnetically attached ferrous 22 material revolves around the central axis 14 of the magnetic drum separator 10 until the ferrous 22 material passes out of the magnetic field generated within the magnetic drum separator 10 and falls off the outer shell 12, on the far side of the material stream 24, and onto a second transfer system 30. The non-ferrous 26 materials of the material stream 24 that is not attracted to the outer shell 12 should fall off the first transfer system 28 into a chute 32 or other means for disposal or further processing.

In some instances, small scrap pieces of non-ferrous 26 materials, usually comprising non-magnetic metal including aluminum, copper, lead, etc. as well as other non-ferrous materials (otherwise known as "fluff" or "organic material") including stones, cloth, plastic, glass, rubber, etc., will attach to the ferrous 22 material and unintentionally become magnetically attached to the outer shell 12 along with the ferrous 22 material. When these instances occur, the ferrous 22 material may separate from the non-ferrous 26 materials by shaking the non-ferrous 26 materials off when the ferrous 22 material tumbles on the outer shell 12 as the outer shell 12 rotates. However, ferrous 22 material tends to slide along the smooth surface of the outer circumference of the outer shell 12 instead of tumbling. The ferrous 22 material will slide until the material has clumped together or clumped against one side of the next standard cleat 20. This clumping inhibits the ferrous 22 material from being able to tumble around such that the non-ferrous 26 materials cannot be shaken off. The non-ferrous 26 materials also get trapped in small crevices formed when adjacent pieces of ferrous 22 material clump together. Magnetic separation alone cannot effectively remove such non-ferrous 26 materials from the ferrous 22 material.

Non-ferrous 26 materials mixed together with ferrous 22 material after the sorting process causes a negative economic impact on the resale value of the sorted materials end product. If a portion of this end product has non-ferrous 26 materials within it, the resale value drops because the weight of the end product does not accurately reflect the amount of ferrous 22 material actually being sold. This typically reduces the resale value of the end product by around five dollars per ton.

Figure 3:
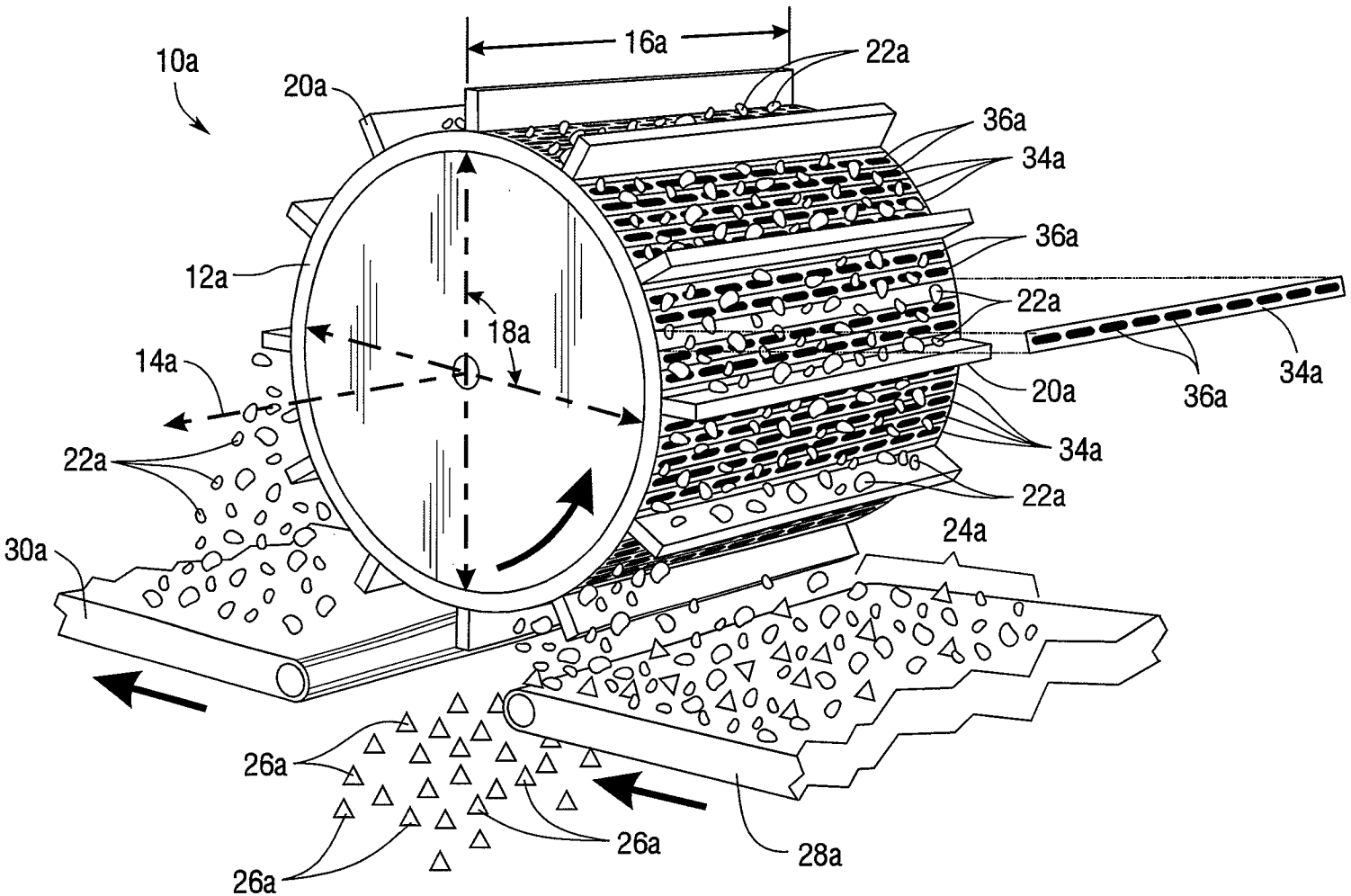
FIG. 3 shows a perspective view of the drum separator having a plurality of traction plates joined around the surface of the outer shell.

To alleviate the sorting problem and subsequent economic problem, in one embodiment, at least one traction plate 34*a* is joined to the surface of the outer shell 12*a* as shown in FIG. 3. Each traction plate 34*a* has a plurality of integral traction elements 36*a* on the outer surface of the traction plate 34*a*. These traction elements 36*a* on the traction plates 34*a* break up the smoothness of the surface of the outer shell 12*a* and prevent the ferrous 22*a* material from sliding along the surface of the outer shell 12*a*. Instead of sliding along the outer shell 12*a*, the edges of the ferrous 22*a* material catch on the rough uneven surface created by the traction elements 36*a* and force the ferrous 22*a* material to tumble on the outer shell 12*a* which will separate non-ferrous material 26*a* from the ferrous material 22*a*.

The traction elements 36*a* on the traction plates 34*a* also keep the ferrous 22*a* material from clumping together or clumping against one side of the next standard cleat 20*a*. Ferrous 22*a* material of different shapes and sizes will tumble on the surface of the outer shell 12*a* at different speeds and along different paths, in effect, causing the material to stagger and further spread out along the surface of the outer shell 12*a*. This staggering effect also further helps to separate ferrous 22*a* material from any trapped non-ferrous material 26*a* by giving the material more tumbling space and not clump together or clump against standard cleats 20*a* on the outer shell 12*a*.

The traction plates 34*a* are mounted onto and cover the surface of the outer shell 12*a*. The traction plates are sized to fit the tubular length 16*a* of the outer shell 12*a*. If the outer shell 12*a* has standard cleats 20*a*, the traction plates 34*a* mount onto the portions of the outer shell 12*a* that are between each standard cleat 20*a*. If the outer shell 12*a* does not have standard cleats 20*a*, the traction plates 36*a* could be made from a single component that completely wraps around the outer shell 12*a*. However, it does not matter whether the traction plates 34*a* are made from a single component or a plurality of components or if the entire surface of the outer shell 12*a* is covered, so long as enough of the surface of the outer shell 12*a* is covered that the ferrous 22*a* material tumbles and does not clump together.

The traction plates 34*a* are typically made from manganese steel, but stainless steel or any other material strong enough to withstand the long term use incorporated with the daily functions of magnetic drum separator 10*a* is sufficient. The traction plates 34*a* may also be releasably joined to the outer shell 12*a* so long as these plates can withstand the long term use incorporated with the daily functions of magnetic drum separator 10*a* as well.

Figure 4:
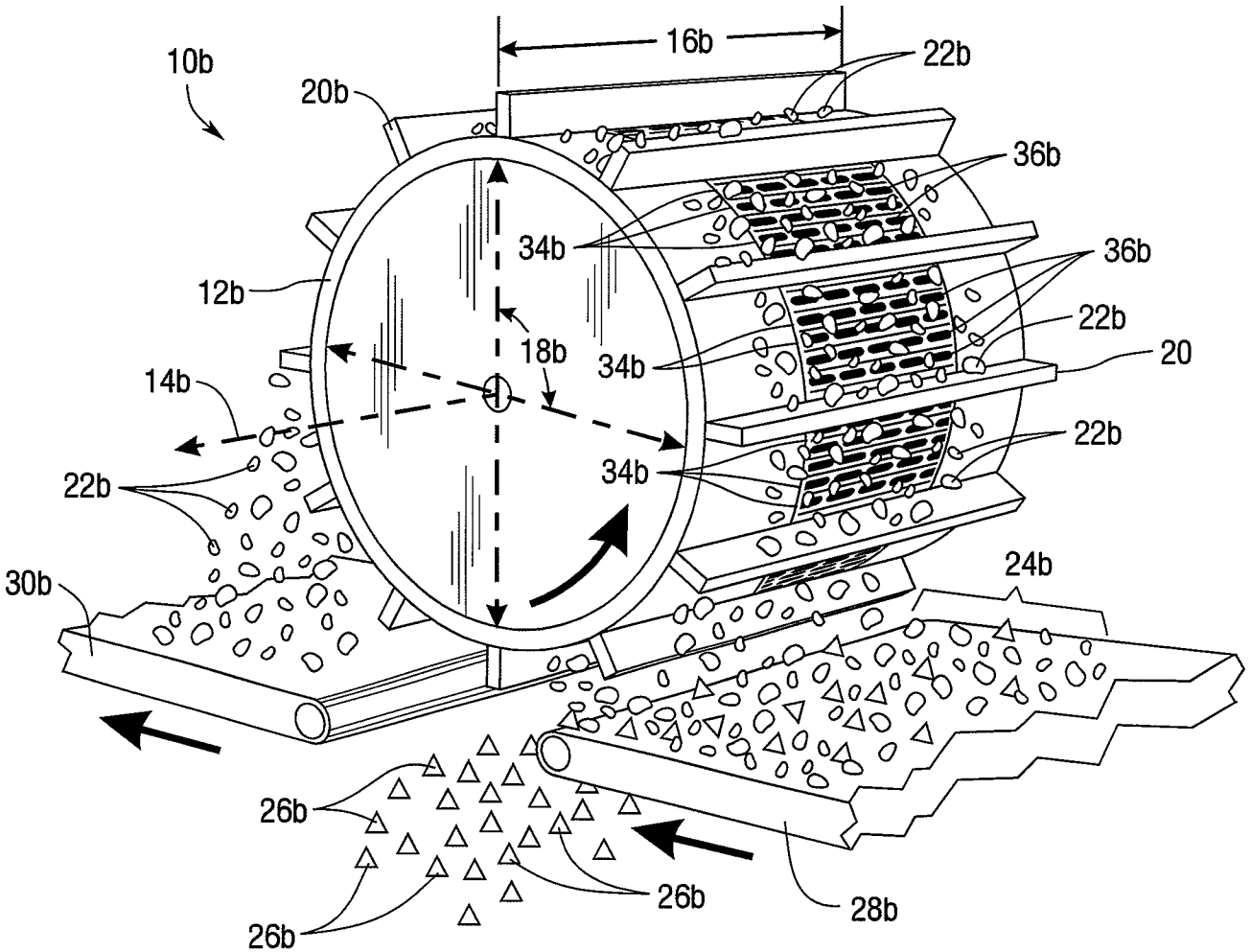
FIG. 4 shows a perspective view of the drum separator having a plurality of traction plates joined around the surface of the outer shell that are shorter than the tubular length of the outer shell.

In another embodiment, as shown in FIG. 4, the traction plates 34*b* are not sized to fit the tubular length 16*b* of the outer shell 12*b*. Here the traction plates 34*b* are sized to fit a length that is shorter than the tubular length 16*b* of the outer shell 12*b*. In this embodiment, any length of the traction plates 34*b* that is shorter than the tubular length 16*b* of the outer shell 12*b* will suffice, so long as the traction plates 34*b* cover enough of the surface area of the outer shell 12*b* that the ferrous 22*b* material tumbles on the outer shell 12*b* and does not clump together.

Figure 5:
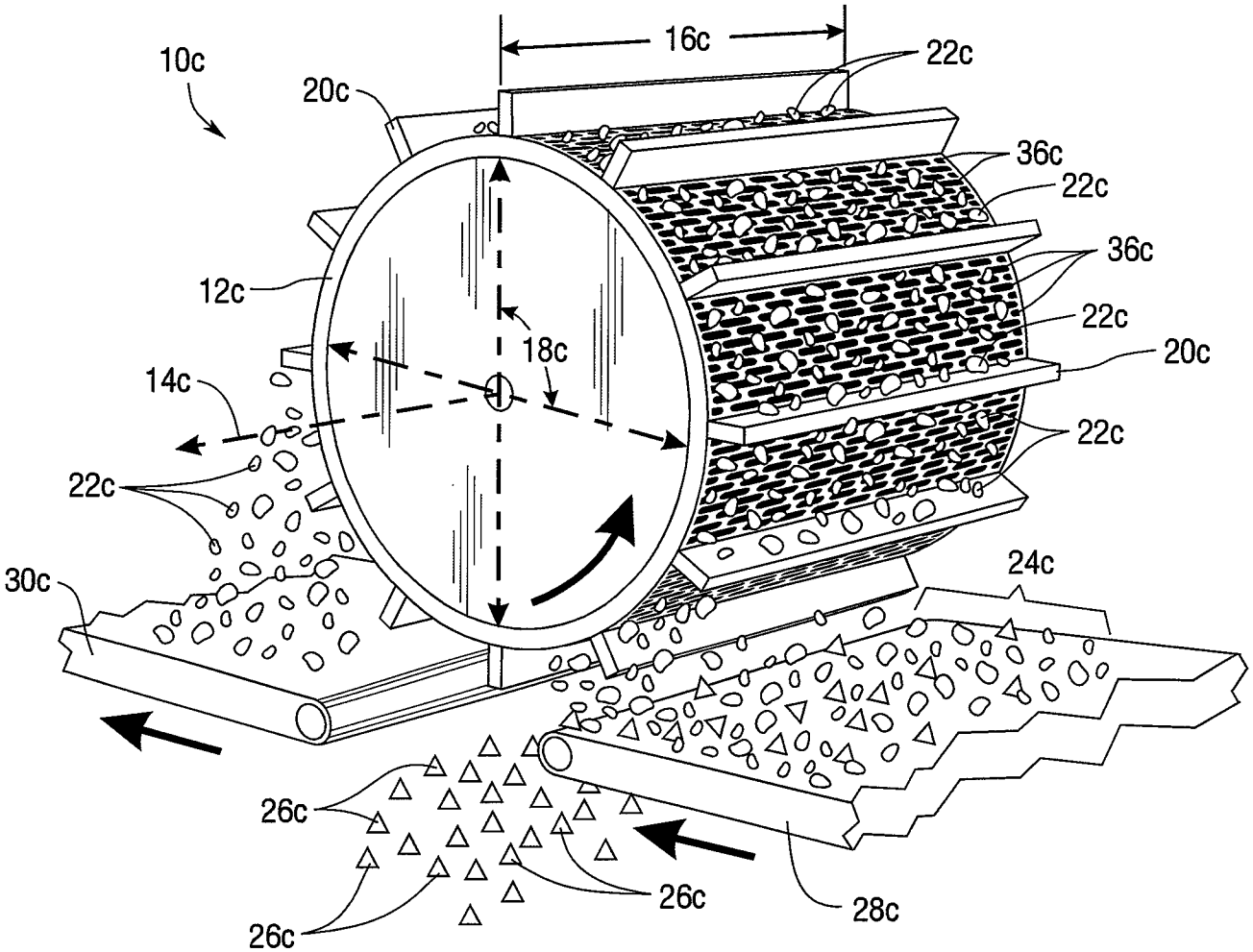
FIG. 5 shows a perspective view of the drum separator having a plurality of integral traction elements around the surface of the outer shell.

In another embodiment, as shown in FIG. 5, the outer shell 12*c* has a plurality of integral traction elements 36*c*. These traction elements 36*c* are embossed or impressed or both embossed and impressed directly on to the outer shell 12*c*. These traction elements 34*c* break up the smoothness of the surface of the outer shell 12*c* and prevent the ferrous 22*c* material from sliding along the surface of the outer shell 12*c*. Instead of sliding along the outer shell 12*c*, the edges of the ferrous 22*c* material catch on the rough uneven surface created by the traction elements 36*c* and force the ferrous 22*c* material to tumble on the outer shell 12*c*.

The traction elements also keep the ferrous 22*c* material from clumping together. Ferrous 22*c* material of different shapes and sizes will tumble on the surface of the outer shell 12*c* at different speeds and along different paths, in effect, causing the ferrous 22*c* material to stagger and further spread out along the surface of the outer shell 12*c*. This staggering effect also helps to further separate ferrous 22*c* material such that the ferrous 22*c* material will have more tumbling space and not clump together or clump against any standard cleats 20*c* on the outer shell 12*c*.

Figure 6:
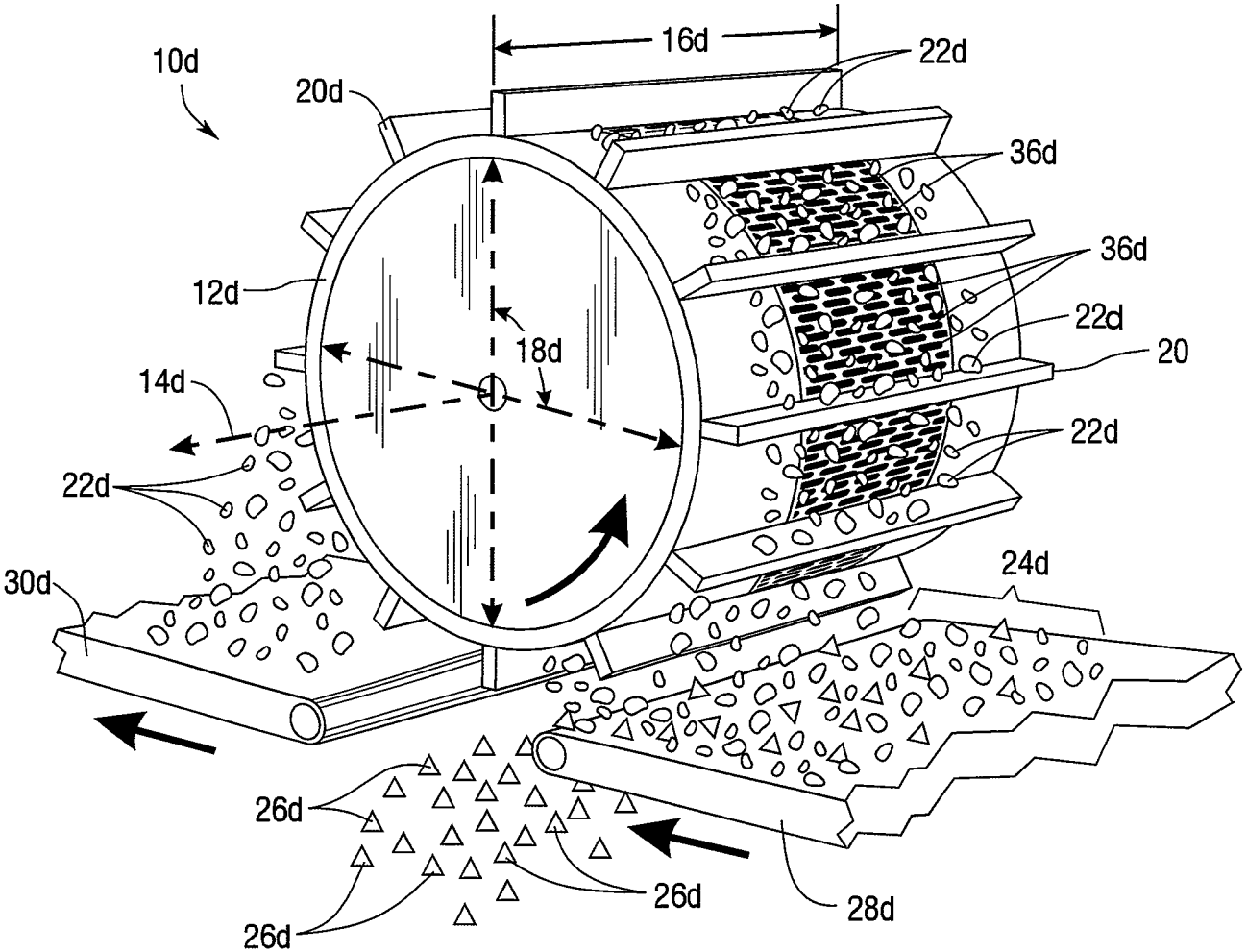
FIG. 6 shows a perspective view of the drum separator having a plurality of integral traction elements covering a portion of the surface that is shorter than the tubular length of the outer shell.

In another embodiment, as shown in FIG. 6, the integral traction elements 34*d* do not span the entire tubular length 16*d* of the outer shell 12*d*. Here, the integral traction elements 34*d* cover a length that is shorter than the tubular length 16*d* of the outer shell 12*d*. Any length of the integral traction elements 34*d* will suffice, so long as the traction elements 34*d* cover enough of the surface of the outer shell 12*d* that the ferrous 22*d* material will tumble and does not clump together.

Figure 7:
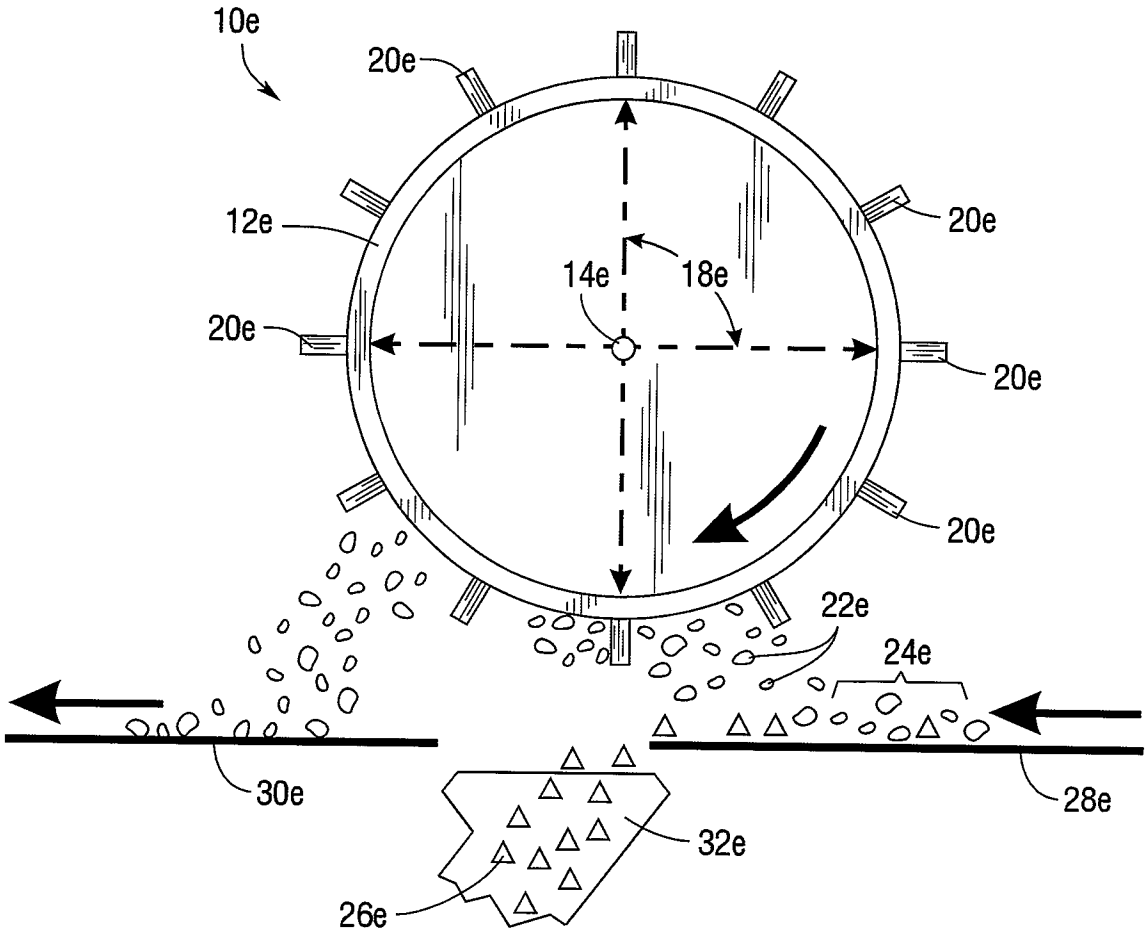
FIG. 7 shows a magnetic drum separator having a reversed rotation operation.
Figure 8:
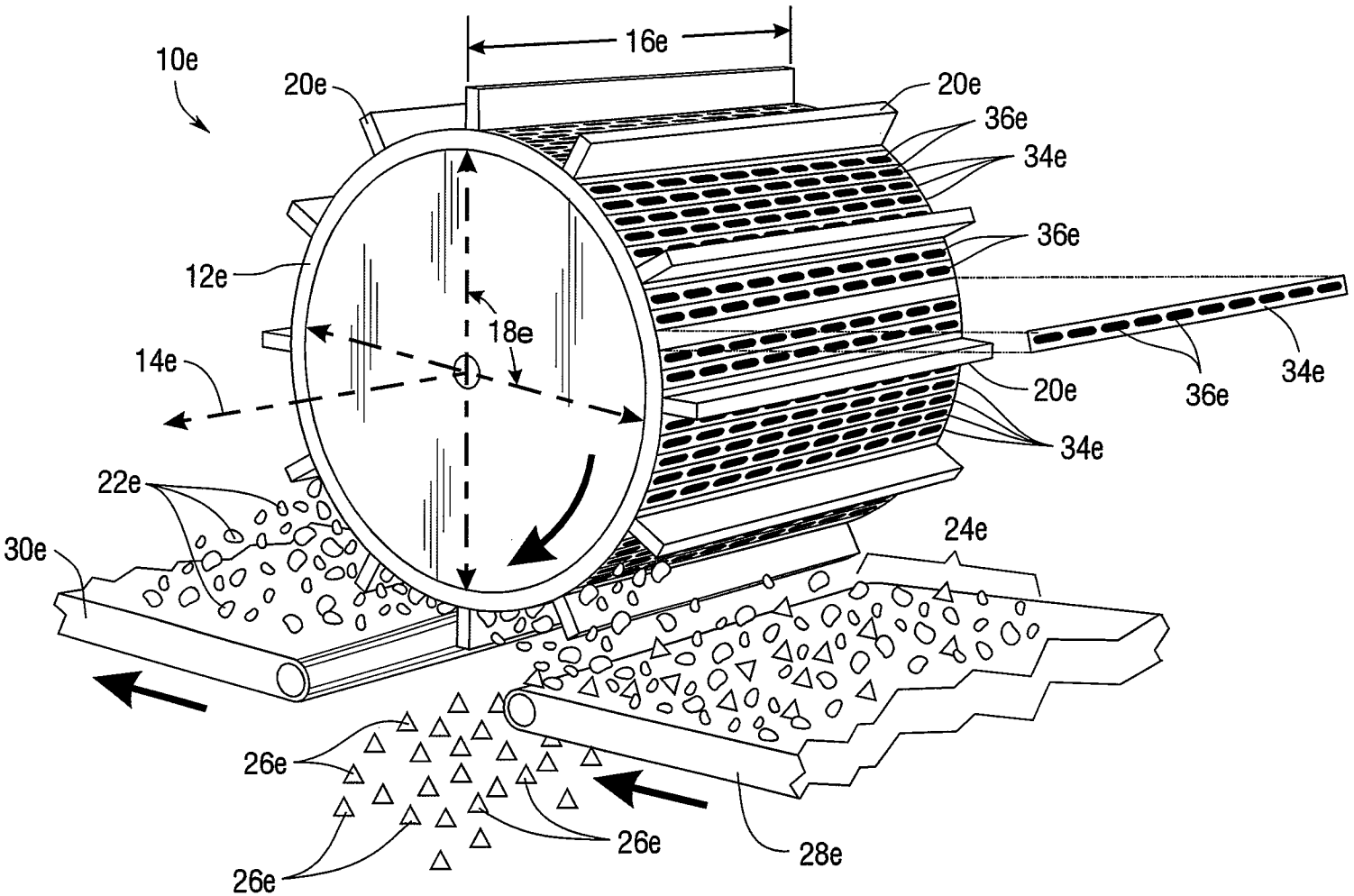
FIG. 8 shows a perspective view of the drum separator of FIG. 7 and having a plurality of traction plates joined around the surface of the outer shell.

FIGS. 7 and 8 show a variation of the embodiments shown and described in FIGS. 2 and 3 above. In these embodiments, the rotation of the outer shell 12*e* is reversed. Ferrous 22*e* material is magnetically attracted to the drum separator 10*e* and becomes magnetically attached to the lower portion of the outer shell 12*e*. As the outer shell 12*e* rotates, the plurality traction elements 36*e* on the outer surface of the traction plate 34*e*, joined to the outer shell 12*e*, causes the magnetically attached ferrous 22*e* material to tumble (as discussed in greater detail above) while revolving around this lower portion of the magnetic drum separator 10*e*. Once the ferrous 22*e* material passes out of the magnetic field generated within the magnetic drum separator 10*e*, the ferrous 22*e* material will drop off the outer shell 12*e*, on the far side of the material steam 24*e*, and onto a second transfer system 30*e*. The non-ferrous 26*e* materials of the material stream 24*e* that is not attracted to the outer shell 12*e* should fall off the first transfer system 28*e* into a chute 32*e* or other means (not shown) for disposal or further processing. Non-ferrous 26*e* materials non-permanently attached to the ferrous 22*e* material (as discussed above) will also separate from of the ferrous 22*e* material by shaking off and falling directly into the chute 32*e* and will not fall back onto the first transfer system 28*e*.

Figure 9:
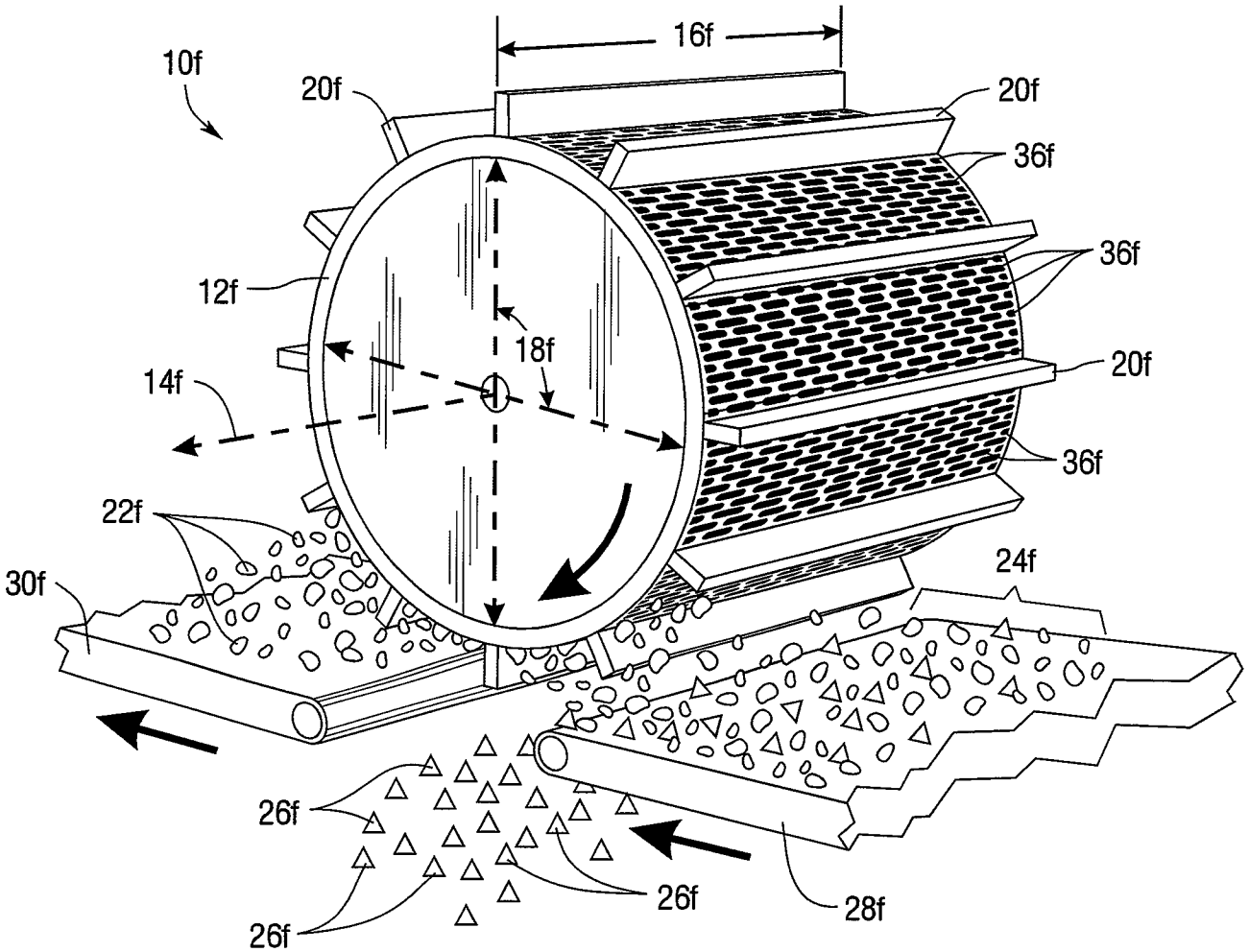
FIG. 9 shows a perspective view of the drum separator of FIG. 7 and having a plurality of integral traction elements around the surface of the outer shell.

FIG. 9 shows a variation of the embodiment shown and described in FIG. 5. In this embodiment, the rotation of the outer shell 12*f* is reversed with the operation as discussed in greater detail above for FIGS. 7 and 8. In this embodiment, as the outer shell 12*f* rotates, a plurality of integral traction elements 36*f* embossed on the outer surface of the outer shell 12*f* causes the magnetically attached ferrous 22*e* material to tumble (as discussed in greater detail above) while revolving around this lower portion of the magnetic drum separator 10*f*. Once the ferrous 22*f* material passes out of the magnetic field generated within the magnetic drum separator 10*f*, the ferrous 22*f* material will drop off the outer shell 12*f*, on the far side of the material steam 24*f*, and onto a second transfer system 30*f*. The non-ferrous 26*f* materials of the material stream 24*f* that is not attracted to the outer shell 12*f* should fall off the first transfer system 28*f* into a chute 32*f* or other means (not shown) for disposal or further processing. Non-ferrous 26*f* materials non-permanently attached to the ferrous 22*f* material (as discussed above) will also separate from the ferrous 22*f* material by shaking off and falling directly into the chute 32*f* and will not fall back onto the first transfer system 28*f*.

Figure 10:
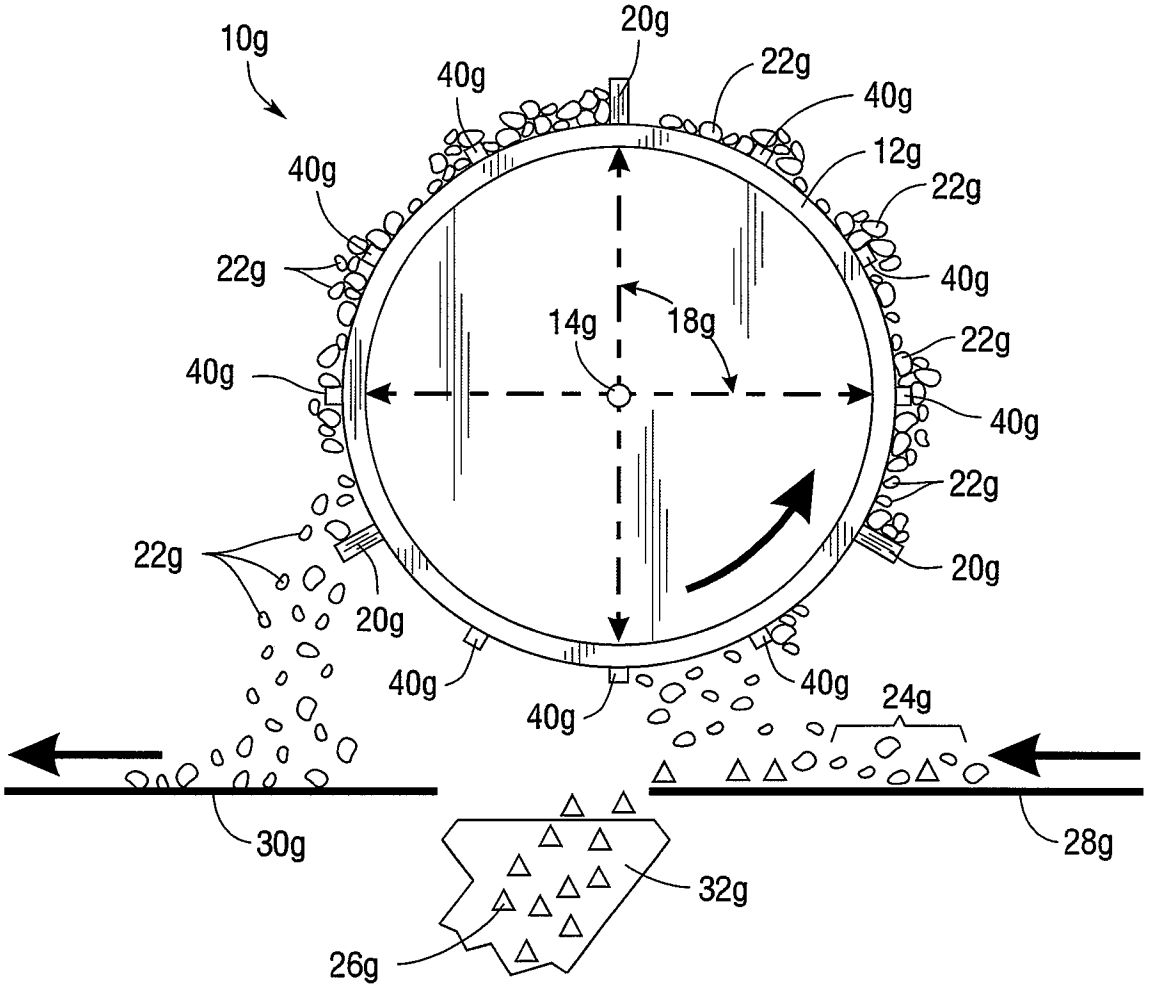
FIG. 10 shows a magnetic drum separator having multiple standard cleats and multiple minor cleats in operation.
Figure 11:
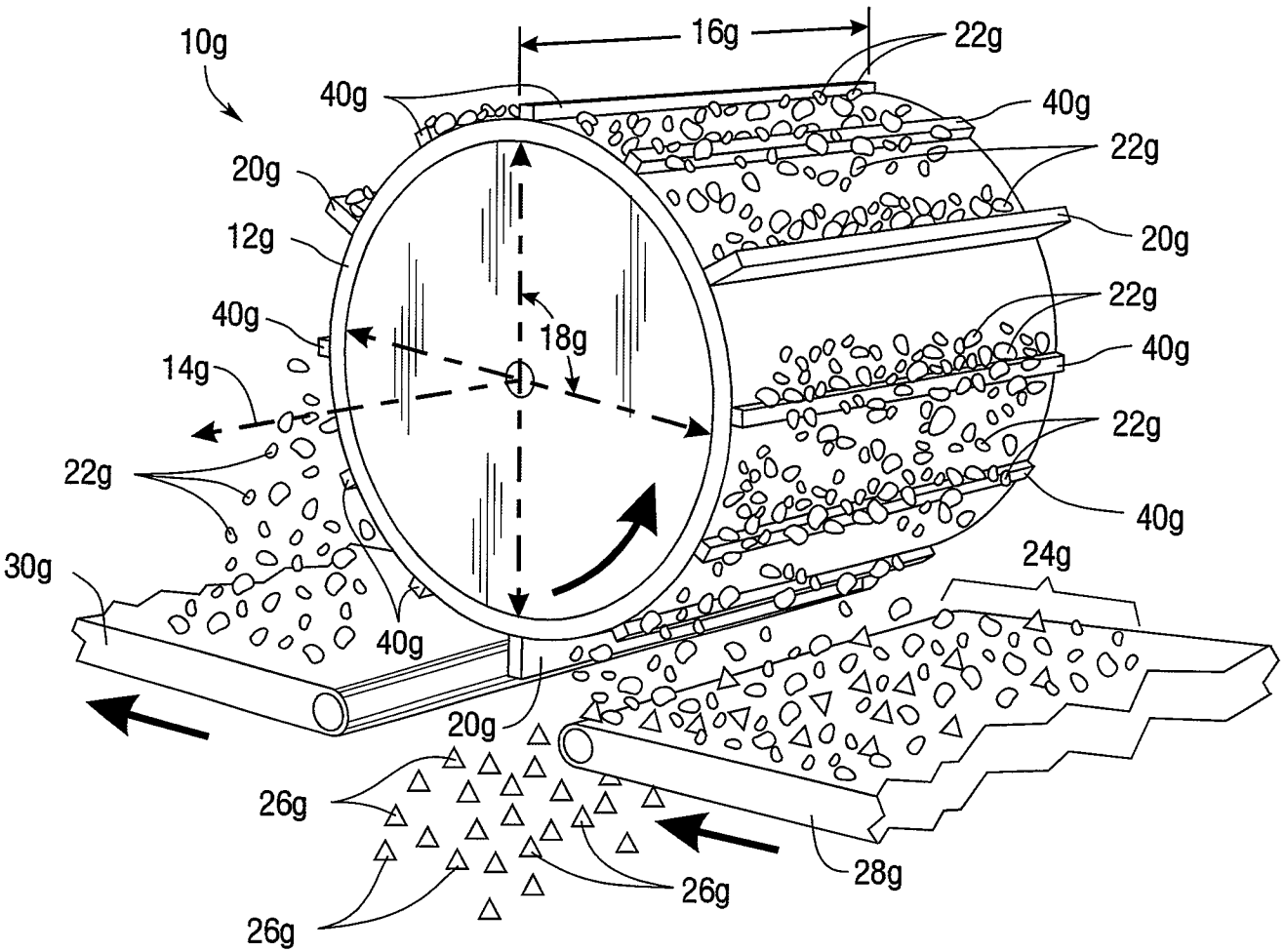
FIG. 11 shows a perspective view of the drum separator of FIG. 10.

Traction elements 36 integral to the outer shell 12 and outer surface of traction plates 34 work well with smaller ferrous 22 material pieces, but not with certain kinds of larger ferrous 22 material pieces. To overcome this problem some embodiments of the magnetic drum separator 10*g*, as shown in FIGS. 10 and 11, incorporate minor cleats 40*g* that are particularly effective with the larger sized ferrous 22*g* material pieces unaffected by other embodiments of traction elements (as discussed above). Unlike standard cleats 20*g* that function, as in earlier embodiments, to ensure all magnetically attached ferrous 22*g* material revolves around the central axis 14*g* of the magnetic drum separator 10*g*, these minor cleats 40*g* function as traction elements in their own right. Instead of sliding along the outer shell 12*g*, the edges of the affected ferrous 22*g* material will catch on a minor cleat 40*g* and force the affected ferrous 22*g* material to tumble or roll or both tumble and roll over that minor cleat 40*g*.

These minor cleats 40*g* also keep the affected ferrous 22*g* material from clumping together or clumping against one side of the nearest standard cleat 20*g* (if any have been joined to the outer shell 12*g*). Ferrous 22*g* material of different shapes and sizes will tumble or roll or both tumble and roll over the minor cleats 40*g* at different speeds and along different paths, in effect, causing the ferrous 22*g* material to stagger and further spread out along the surface of the outer shell 12*g*. This staggering effect also further helps to separate ferrous 22*g* material such that the ferrous 22*g* material will have more tumbling space and not clump together or clump against any standard cleats 20*g* on the outer shell 12*g*.

In the embodiment shown in FIGS. 10 and 11, the outer shell 12*g* has a plurality of minor cleats 40*g* between standard cleats 20*g*. The minor cleats 40*g* are shorter in height than standard cleats 20*g* that must be tall enough to push the largest sized pieces of ferrous 22*g* material around the magnetic drum separator 10*g*. Typically the minor cleats 40*g* range from 0.5 inches to 2.5 inches in height after being joined to the outer shell 12*g*. One having ordinary skill in the art will see that any height of the minor cleats 40*g* may work so long as the minor cleats 40*g* cause ferrous 22*g* material to tumble or roll or both tumble and roll over the minor cleats 40*g* on the outer.

Figure 12:
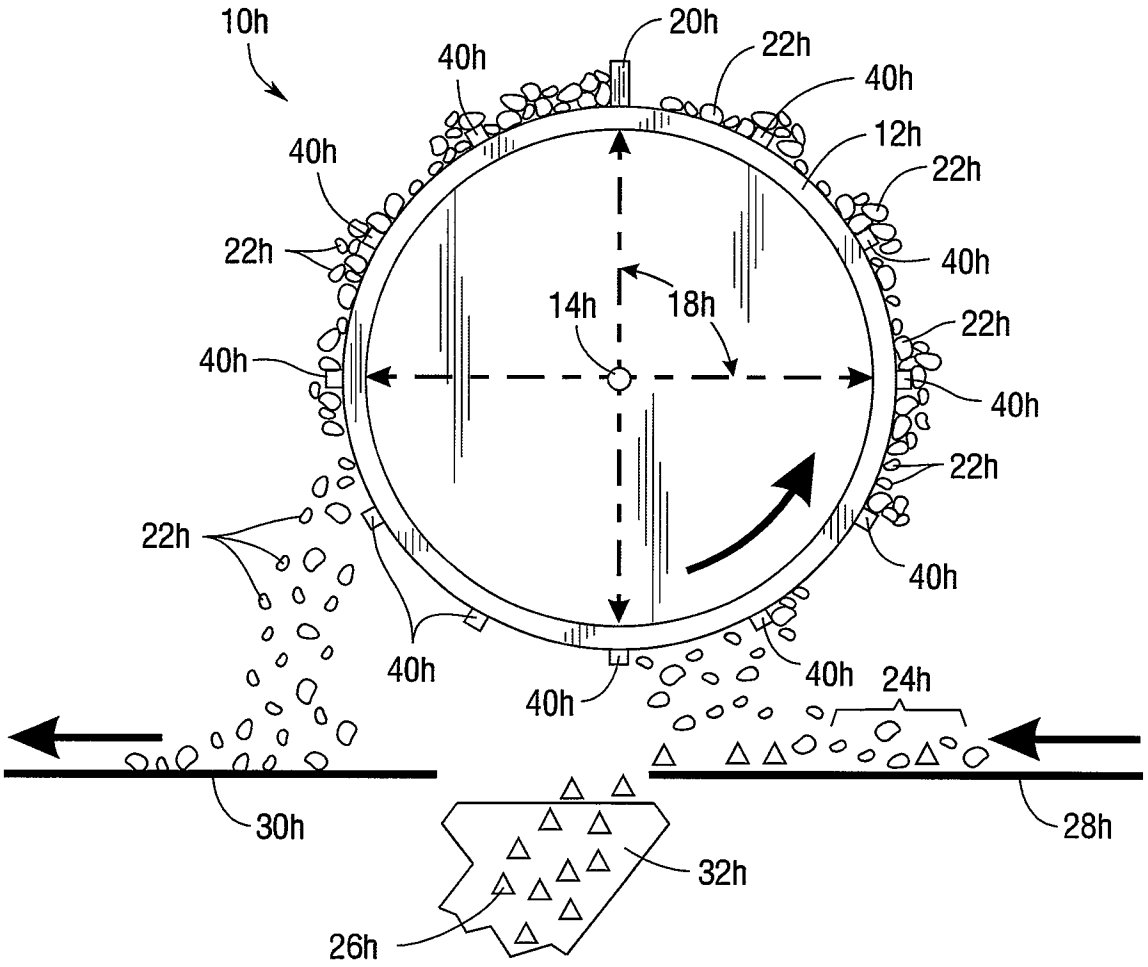
FIG. 12 shows a magnetic drum separator having a single standard cleat and multiple minor cleats in operation.

One of ordinary skill in the art will also understand that the number of standard cleats 20*g* can vary from as few as one to as many as are needed for the particular application of the magnetic drum separator 10*g*. For example, in the embodiment shown in FIG. 12, the outer shell 12*h* has a plurality of minor cleats 40*h* and a single standard cleat 20*h*. As discussed above, the minor cleats 40*h* are shorter in height than standard cleats 20*h*. Typically these minor cleats 40*h* are sized to fit the tubular length 16*h* of the outer shell 12*h*. In some instances the minor cleats 40*h* are sized to fit a length that is shorter than the tubular length 16*h* of the outer shell 12*h*. Sizing the minor cleats 40*h* to fit a length that is shorter than the tubular length 16*h* of the outer shell 12*h* can allow segmented configurations or staggered configurations or both configurations of the minor cleats 40*h* along the surface of the outer shell 12*h*. If the outer shell 12*h* has standard cleats 20*h*, the minor cleats 40*h* mount onto the portions of the outer shell 12*h* that are between each of these standard cleats 20*h*.

Figure 13:
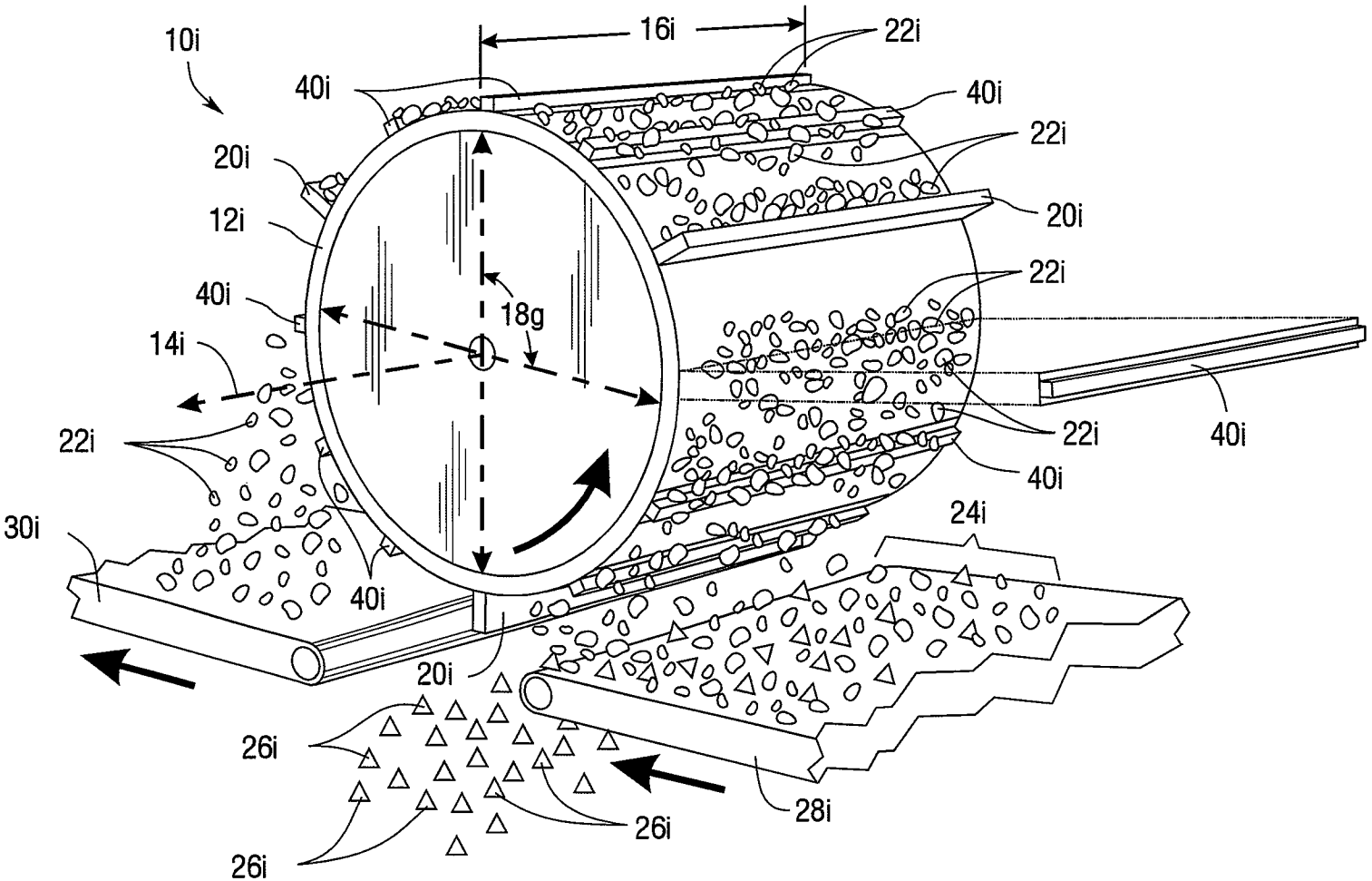
FIG. 13 shows a perspective view of the drum separator of FIG. 10 and having a plurality of traction plates having minor cleats as the traction elements joined around the surface of the outer shell.

In other embodiments, the minor cleats 40*i* could be the traction elements 36*i* of the traction plates 34*i*. As shown in FIG. 13, each traction plate 34*i* has a single minor cleat 40*i*, integral to the outer surface of the traction plate 34*i*. These traction plates 34*i* having minor cleats 40*i* as traction elements are typically made from manganese steel, but stainless steel or any other material strong enough to withstand the long term use incorporated with the daily operations of magnetic drum separator 10*i* is sufficient. These traction plates 34*i* having minor cleats 40*i* as traction elements may also be releasably joined to the outer shell 12*i* so long as these plates can withstand the long term use incorporated with the daily operations of magnetic drum separator 10*i*.

Figure 14:
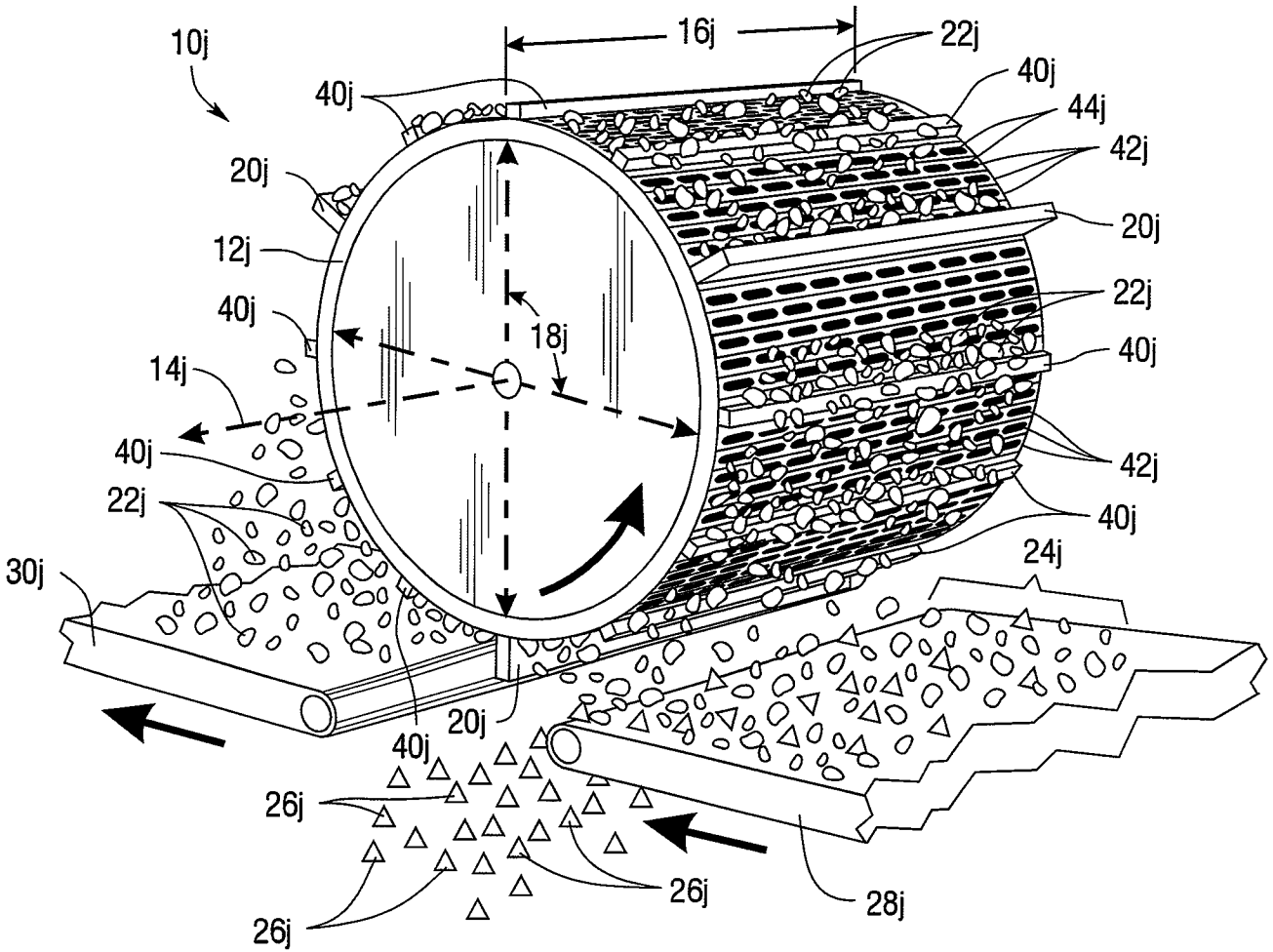
FIG. 14 shows a perspective view of the drum separator of FIG. 10 and having a plurality of traction plates joined around the surface of the outer shell.

As shown in FIG. 14, it is also possible to combine different kinds of traction elements 36*j* on a single magnetic drum separator 10*j*. In this embodiment the separation process works with ferrous 22*j* materials that have a wide range of particulate sizes. The outer shell 12*j* has both a plurality of minor cleats 40*j* and additional traction plates 42*j* having additional traction elements 44*j* joined to the outer shell 12*j*. These additional traction plates 42*j* function to catch the edges of the ferrous 22*j* material too small to for the minor cleats 40*j*, while the minor cleats 40*j* work on material that will not catch on the traction elements 36*j* of the traction plates 34*j*.

The minor cleats 20*j* working in conjunction with the additional traction plates 42*j* to break up the smoothness of the surface of the outer shell 12*j* and prevent the ferrous 22*j* material from sliding along the surface of the outer shell 12*j*. Instead of sliding along the outer shell 12*j*, the edges of the ferrous 22*j* material catch on a minor cleat 40*j* or additional traction elements 44*j* on the additional traction plates 42*j* and force the ferrous 22*j* material to tumble or roll or both tumble and roll over that minor cleat 40*j* or additional traction elements 44*j* on the additional traction plates 42*j* or both.

Figure 15:
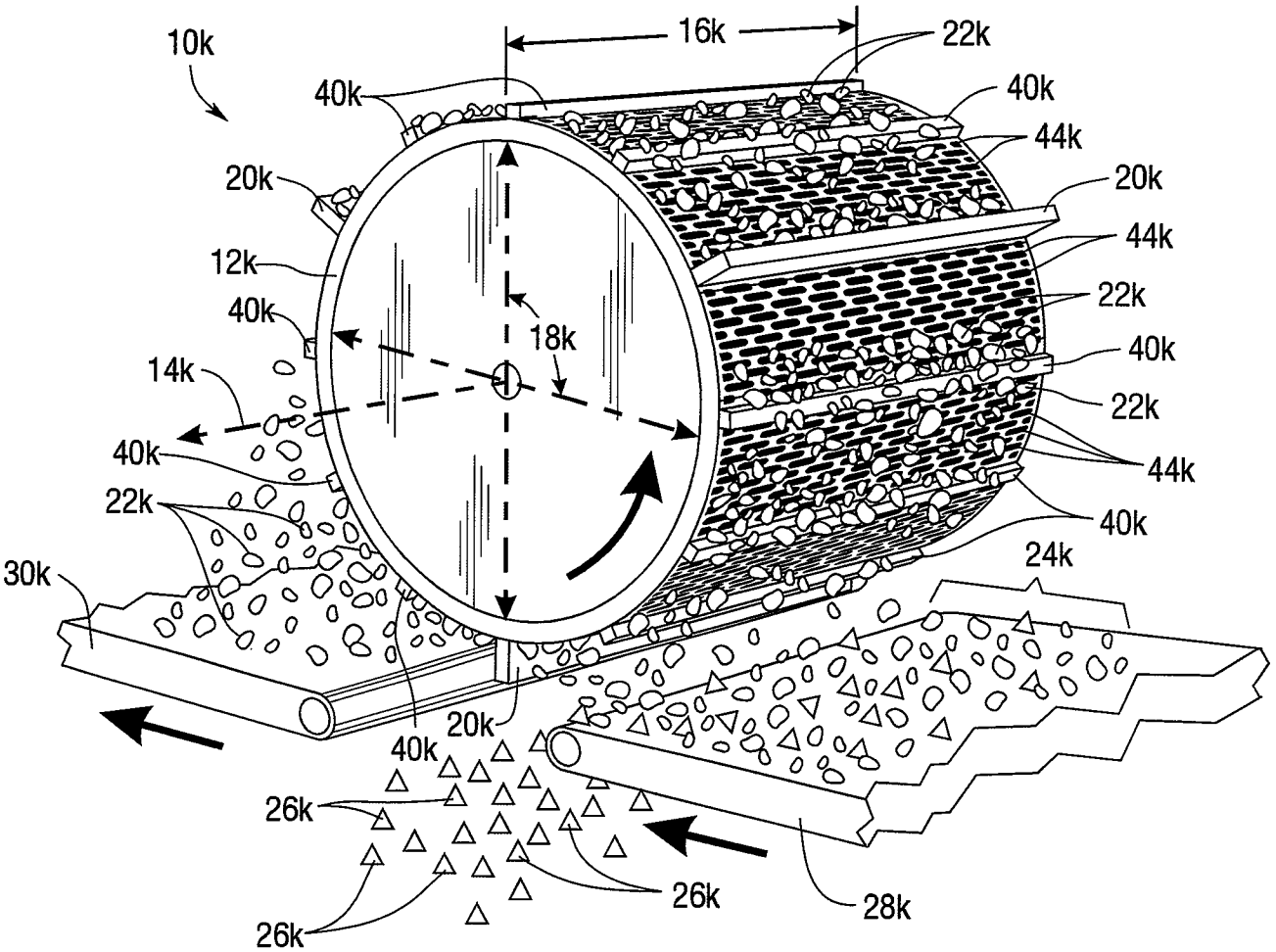
FIG. 15 shows a perspective view of the drum separator of FIG. 10 and having a plurality of integral traction elements around the surface of the outer shell.

As shown in FIG. 15, in another embodiment, the outer shell 12*k* has both a plurality of minor cleats 40*k* joined to the outer shell 12*k* and additional traction elements 44*k* integral to the outer shell 12*k*. These additional traction elements 44*k* function to cause the edges of the ferrous 22*k* material, too small for the minor cleats 40*k*, to be used for traction purposes, to catch on the additional traction plates 42*k* and force such ferrous 22*k* material to tumble.

Figure 16A:
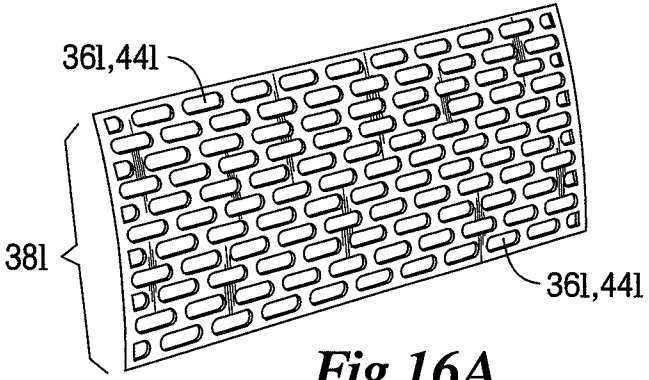
FIG. 16A shows a perspective view of an embodiment of the traction element having a series of perforations along the surface of the traction element.
Figure 16B:
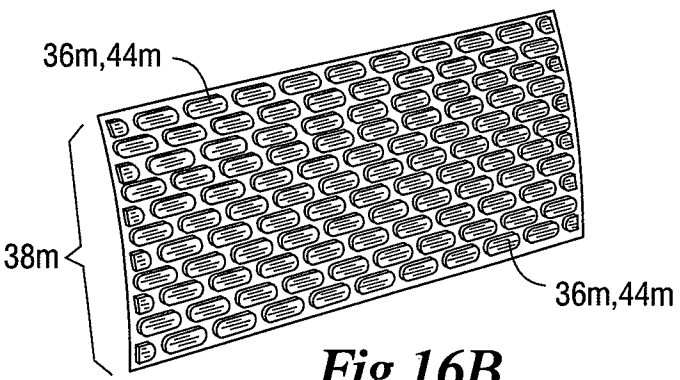
FIG. 16B shows a perspective view of an embodiment of the traction element having a series of raised bumps along the surface of the traction element.
Figure 16C:
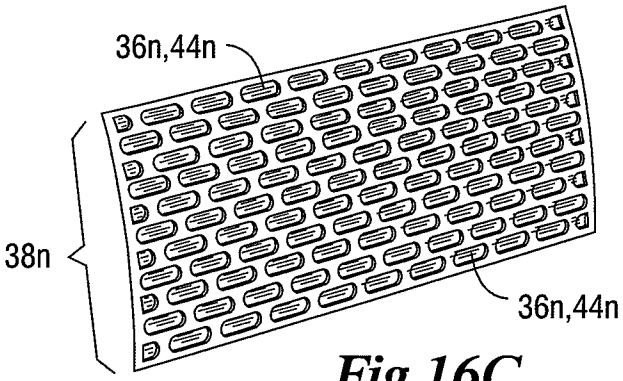
FIG. 16C shows a perspective view of an embodiment of the traction element having a series of negative indentations along the surface of the traction element.
Figure 16D:
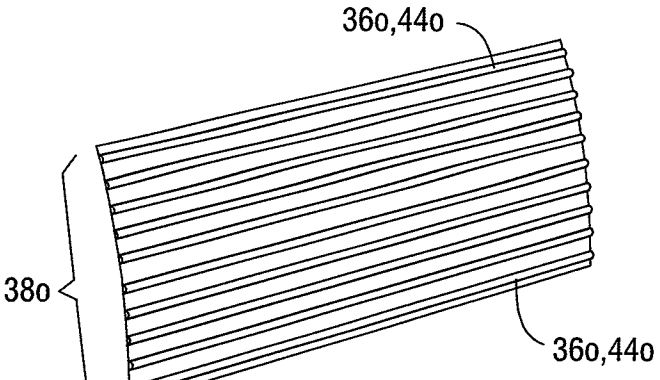
FIG. 16D shows a perspective view of an embodiment of the traction element having a series of protruding ridges along the surface of the traction element.
Figure 16E:
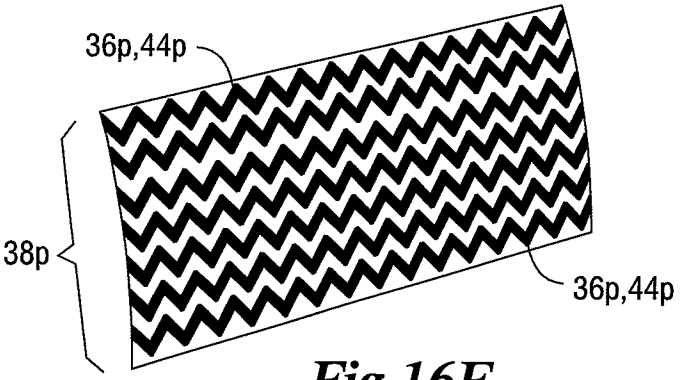
FIG. 16E shows a perspective view of an embodiment of the traction element having a series of serrated teeth along the surface of the traction element.
Figure 16F:
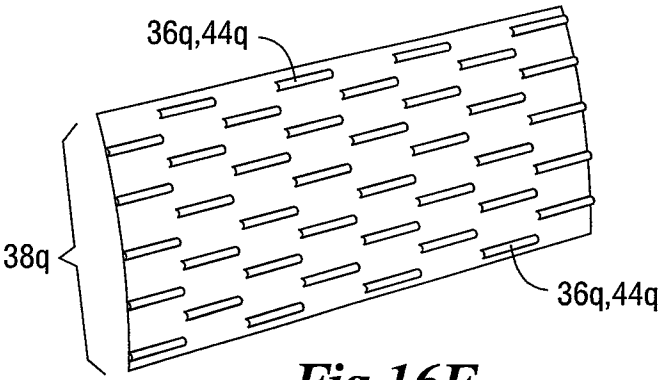
FIG. 16F shows a perspective view of an embodiment of the traction element having a series of segmented protruding ridges along the surface of the traction element.
Figure 16G:
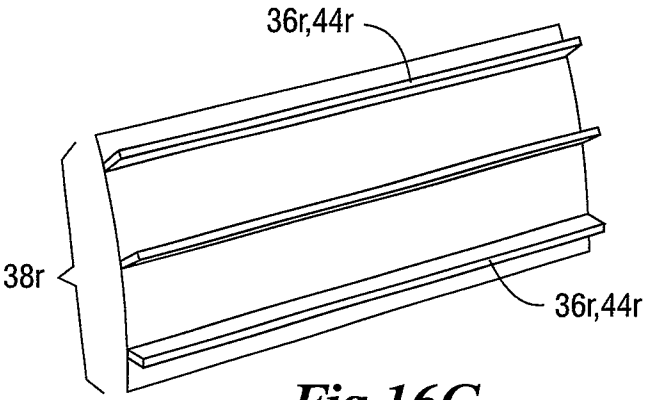
FIG. 16G shows a perspective view of an embodiment of the traction element having minor cleats along the surface of the traction element.
Figure 16H:
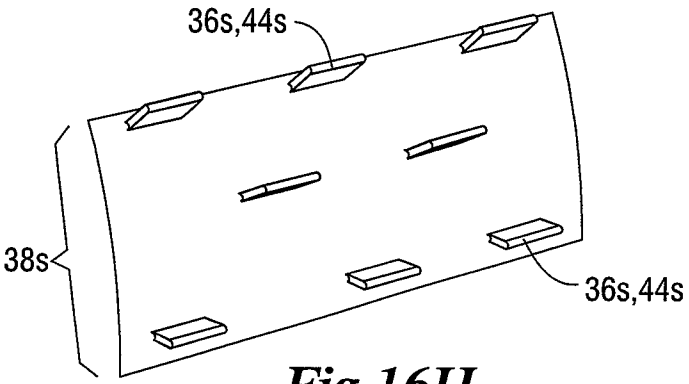
FIG. 16H shows a perspective view of an embodiment of the traction element having segmented minor cleats along the surface of the traction element.

Comparing FIGS. 16A, through 16E, both the traction elements 36*l-s* and additional traction elements 44*l-s* can comprise various different geometric patterns 38*l-s* embossed or impressed or both embossed and impressed into the traction plates (not shown) themselves or directly into the outer shell (not shown). The embodiment of the traction element 36*l*/additional traction element 44*l* shown in FIG. 16A has a geometric pattern 38*l* that is a plurality of perforations cut entirely through the surface of the traction plate. FIG. 16B shows an embodiment of the traction element 36*m*/additional traction element 44*m* having a geometric pattern 38*m* that is a plurality of embossed or raised bumps that push up from the surface of the traction plate or outer shell as applicable. FIG. 16C, shows an embodiment of the traction element 36*n*/additional traction element 44*n* with a geometric pattern 38*n* that is a series of negative indentations or impressions that push into the surface of the traction plate or outer shell as applicable. FIG. 16D shows an embodiment of the traction element 36*o*/additional traction element 44*o* having a geometric pattern 38*o* that is a series of protruding ridges that raise up from the surface of the traction plate or outer shell as applicable. FIG. 16E shows the embodiment of the traction element 36*p*/additional traction element 44*p* having a geometric pattern 38*p* that is a series of serrated teeth protruding from the surface of the traction plate or outer shell as applicable. FIG. 16F shows an embodiment of the traction element 36*q*/additional traction element 44*q* having a geometric pattern 38*q* that is a series of protruding ridges that are segmented into equal portions, creating a staggered pattern raised up from the surface of the traction plate or outer shell as applicable. FIG. 16G shows the embodiment of the traction element 36*r*/additional traction element 44*r* having a geometric pattern 38*r* that is a series of minor cleats that raise up from the surface of the traction plate traction element is arranged in an angled manner near the outer edges of the tubular length of said outer shell or outer shell as applicable. FIG. 16H shows the embodiment of the traction element 36*s*/additional traction elements 44*s* having a geometric pattern 38*q* that is a series of minor cleats that are segmented into equal portions, creating a staggered pattern raised up from the surface of the traction plate or outer shell as applicable. It should be obvious to one having ordinary skill in the art that the embodiments of traction elements and additional traction elements 44*l-s* are not limited to the geometric patterns 36*l-s* as described herein.

The outer shell of the magnetic drum separator could comprise a variety of traction plates each having their own geometric pattern of traction elements/additional traction elements on the traction plate. The outer shell of the magnetic drum separator could also comprise traction plates with traction elements/additional traction elements having a variety of different geometric patterns on the traction plate. If the outer shell has integral traction elements/additional traction elements on the outer surface of the outer shell, the outer shell could comprise a variety of geometric patterns of these integral traction elements/additional traction elements. As such, different variations of geometric patterns of traction elements/additional traction elements can be strategically located along the outer shell so as to allow for a more even spread of ferrous material along the outer shell as the outer shell rotates.

The geometric patterns of traction elements/additional traction elements can also be strategically arranged, or positioned, along the outer shell so as to manipulate the flow of ferrous material while spreading out along the outer shell as the outer shell rotates. In one such example, magnetic drum separators comprising either electromagnets or permanent magnets will often times produce "dead zones" of weakened magnetic field strength along each of the outer edges of the tubular length of the outer shell. These "dead zones" create what is known as an edge effect, wherein all of the ferrous material ends up clumping towards the center of the tubular length of the outer shell, which ultimately leads to the under-utilization of the surface area of the outer shell.

Figure 17A:
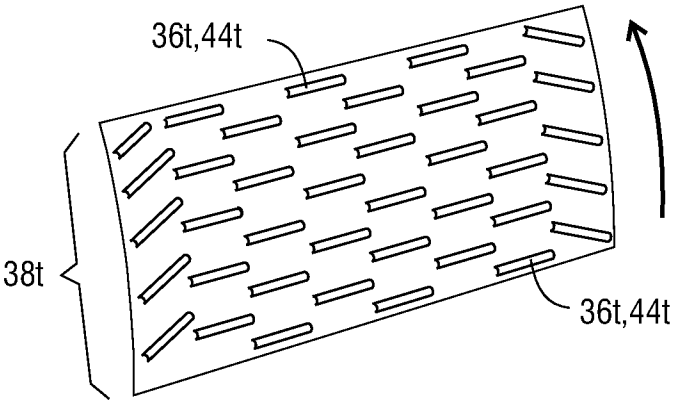
FIG. 17A shows a perspective view of an embodiment of the traction element having a series of segmented protruding ridges that are strategically arranged in an angled manner along the surface of the of the traction element.

As shown in FIG. 17A, to mitigate this edge effect, a variation of geometric patterns 38*t* of traction elements 36*t*/additional traction elements 44*t* can be strategically arranged in an angled, or biased, manner near the outer edges of the tubular length of the outer shell and away from the direction of rotation, to facilitate the spreading of the ferrous material out towards the edges of the outer shell. Spreading the ferrous material outward and into these dead zones, reduces the under-utilization of the surface area of the outer shell from ferrous material clumping together towards the center of the tubular length of the outer shell. It should be understood that arranging the traction elements 36*t*/additional traction elements 44*t* in an angled manner usually begins within 2 feet from each of the outer edges of the tubular length of the outer shell.

However, one having ordinary skill in the art will see that arranging the traction elements 36*t*/additional traction elements 44*t* in an angled manner can begin anywhere along the tubular length of the outer shell, so long as ferrous material spreads into the dead zones, and does not clump together towards the center of the tubular length of the outer shell.

Figure 17C:
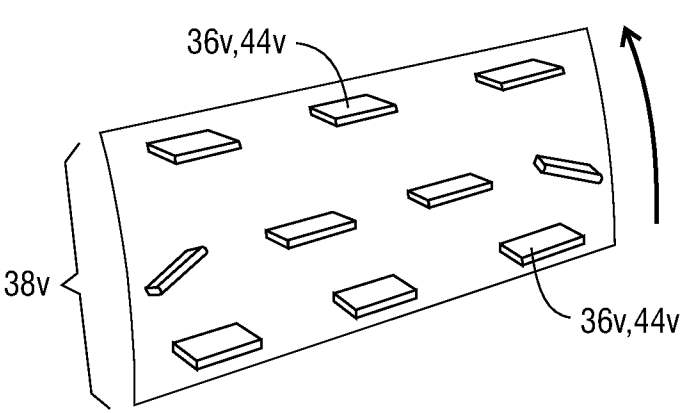
FIG. 17C shows a perspective view of an embodiment of the traction element having segmented minor cleats that are strategically arranged in an angled manner along the surface of the traction element.
Figure 17B:
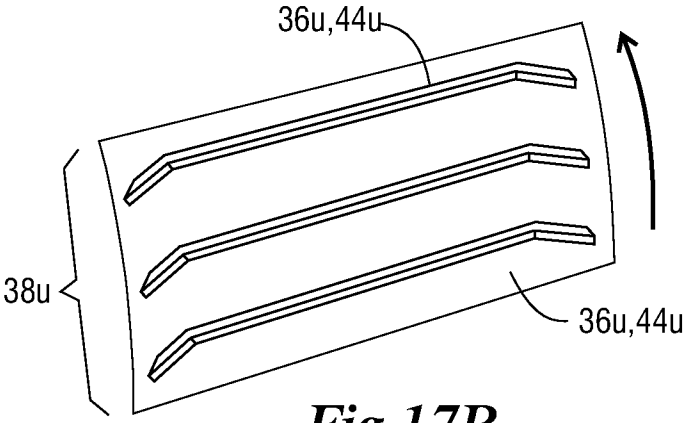
FIG. 17B shows a perspective view of an embodiment of the traction element having minor cleats that are strategically arranged in an angled manner along the surface of the of the traction element.

In FIG. 17A, traction elements 36*t*/additional traction elements 44*t* are a series of protruding ridges with the ridges close to the outer edges angled as shown. FIG. 17B shows a variation of traction elements 36*u*/additional traction elements 44*u* that are minor cleats with the cleats to the outer edges angled as shown. FIG. 17C shows a variation of traction elements 36*v*/additional traction elements 44*v* that are a series of minor cleats that are segmented into equal portions, creating a staggered pattern with the cleats to the outer edges angled as shown. It should be obvious to one having ordinary skill in the art that the embodiments of traction elements 36*t-v*/additional traction elements 44*t-v* are not limited to the geometric patterns 36*t-v* as described herein.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

What is claimed is:

1. A magnetic drum separator for the separation of ferrous and non-ferrous materials from a material stream comprising:
- an outer shell that is rotatable by a drive mechanism;
- said outer shell having a tubular length and a circular cross-section;
- a traction plate joined to said outer shell; and
- said traction plate having a traction element comprising a series of negative indentations, raised bumps, perforations, serrated teeth, protruding ridges, or segmented protruding ridges.

2. The magnetic drum separator of claim 1 wherein said traction plate is made from stainless steel or manganese steel.

3. The magnetic drum separator of claim 1 wherein said traction plate is sized to fit said tubular length of said outer shell.

4. The magnetic drum separator of claim 1 wherein said traction plate is releasably joined to said outer shell.

5. The magnetic drum separator of claim 1 wherein said traction element is arranged in an angled manner near the outer edges of the tubular length of said outer shell.

6. The magnetic drum separator of claim 1 further comprising:
- at least two traction plates joined to said outer shell; and
- one of said at least two traction plates having a traction element that is a minor cleat.

7. A magnetic drum separator for the separation of ferrous and non-ferrous materials from a material stream comprising:
- an outer shell that is rotatable by a drive mechanism;
- said outer shell having a tubular length and a circular cross-section; and
- said outer shell having an integral traction element comprising a series of negative indentations, raised bumps, perforations, serrated teeth, protruding ridges, or segmented protruding ridges.

8. The magnetic drum separator of claim 7 wherein said outer shell is made from stainless steel or manganese steel.

9. The magnetic drum separator of claim 7 wherein said outer shell having said traction element span across said tubular length of said outer shell.

10. The magnetic drum separator of claim 7 wherein said traction element is arranged in an angled manner near the outer edges of the tubular length of said outer shell.

11. The magnetic drum separator of claim 7 further comprising:
- a traction plate joined to said outer shell; and
- said traction plate having a traction element.

12. A magnetic drum separator for the separation of ferrous and non-ferrous materials from a material stream comprising:
- outer shell means for rotation by drive means;
- traction plate means for joining traction means to said outer shell means; and
- said outer shell means having traction means for causing the material stream to tumble on said outer shell means to separate the ferrous material from the non-ferrous material, said traction means comprising a series of negative indentations, raised bumps, perforations, serrated teeth, protruding ridges, or segmented protruding ridges.

13. The magnetic drum separator of claim 12 further comprising a standard cleat joined to said outer shell.

* * * * *